United States Patent [19]

Görtz

[11] Patent Number: 4,731,593

[45] Date of Patent: Mar. 15, 1988

[54] ATTENUATION AND TIME DELAY EQUALIZER FOR A WAVEGUIDE FILTER

[75] Inventor: Franz-Josef Görtz, Oppenweiler, Fed. Rep. of Germany

[73] Assignee: ANT Nachrichtentechnik GmbH, Backnang, Fed. Rep. of Germany

[21] Appl. No.: 916,734

[22] Filed: Oct. 8, 1986

[30] Foreign Application Priority Data

Oct. 9, 1985 [DE] Fed. Rep. of Germany ..... 3536001

[51] Int. Cl.[4] ..... H01P 9/00; H01P 7/06; H01P 1/20

[52] U.S. Cl. ..... 333/28 R; 333/159; 333/208; 333/209

[58] Field of Search ..... 333/156, 157, 159, 28 R, 333/81 R, 81 B, 18, 208–212, 245, 248, 227–235

[56] References Cited

U.S. PATENT DOCUMENTS 4,437,073 3/1984 Thal, Jr. ..... 333/28 R

FOREIGN PATENT DOCUMENTS 2340628 9/1977 France ..... 333/28 R
0035579 3/1980 Japan ..... 333/28 R

OTHER PUBLICATIONS

Wanselow, Robert D., *Journal of the Franklin Institute,* vol. 292, No. 3, Sep. 1971, pp. 179–192.

*Primary Examiner*—Marvin L. Nussbaum
*Attorney, Agent, or Firm*—Spencer & Frank

[57] ABSTRACT

An arrangement for the equalization of attenuation and time delay in a microwave filter utilizing waveguide technology. An equalizer composed of a multi-circuit cavity resonator is coupled via a first coupling aperture to a waveguide which is connected to the filter. The resonator includes at least two individual waveguide sections coupled to each other via a second coupling aperture. The coupling apertures are dimensioned so that the resonator is critically coupled with respect to time delay characteristics. The resonator includes a power-absorbing tuning device for tuning all of the waveguide sections to substantially the same quality factor. The second coupling aperture presents a stepped cross section defining a first area and a second area having a larger cross section than the first area. The resonator further includes at least two screws arranged symmetrically with respect to the longitudinal axis of the resonator and protruding laterally into the second area of the second coupling aperture. The screws influence the time delay of the equalizer as a function of their depth of penetration into the second area.

13 Claims, 3 Drawing Figures

ATTENUATION AND TIME DELAY EQUALIZER FOR A WAVEGUIDE FILTER

BACKGROUND OF THE INVENTION

The present invention relates to an arrangement for the equalization of attenuation and time delay in a microwave filter utilizing waveguide technology, wherein an equalizer having a cavity resonator with at least two circuits is coupled to a filter waveguide via a coupling aperture, the waveguide sections of the cavity resonator also being coupled to each other via coupling apertures and all coupling apertures being dimensioned so that the waveguide sections and the filter waveguide are critically coupled with respect to the time delay characteristic of the filter.

Such an equalizer is described in the *Journal of the Franklin Institute,* Vol. 292, No. 3, September 1971, pp. 179–192. This article explains how the equalizer's attenuation curve depends on the quality factor of the individual resonator circuits. But it does not describe any means by which the attenuation and the time delay of the equalizer can be adjusted independently of each other.

SUMMARY OF THE INVENTION

It is an object of the invention to provide an arrangement of the type described above, in which attenuation and time delay can be adjusted independently of each other.

The above and other objects are accomplished according to the invention in the context of an arrangement for the equalization of attenuation and time delay in a microwave filter utilizing waveguide technology, wherein an equalizer is composed of a multi-circuit cavity resonator coupled via a first coupling aperture to a waveguide which is connected to the filter. The multi-circuit cavity resonator includes at least two individual waveguide sections coupled to each other via a second coupling aperture. The coupling apertures are dimensioned so that all the waveguides are critically coupled with respect to the time delay characteristic of the filter. Additionally, the multi-circuit cavity resonator includes power-absorbing tuning means for tuning all of the waveguide sections to substantially the same quality factor. The second coupling aperture coupling the waveguide sections with each other presents a stepped cross section defining a first area and a second area having a larger cross section than the first area. Further, the multi-circuit cavity resonator includes at least two screws arranged symmetrically with respect to the longitudinal axis of the resonator and protruding laterally into the second coupling aperture in the second area of larger cross section, such screws influencing the time delay of the equalizer as a function of their depth of penetration into the second area.

BRIEF DESCRIPTION OF THE DRAWINGS

The invention is explained in greater detail below with reference to an embodiment shown in the drawings wherein.

DESCRIPTION OF A PREFERRED EMBODIMENT

Figure 1:
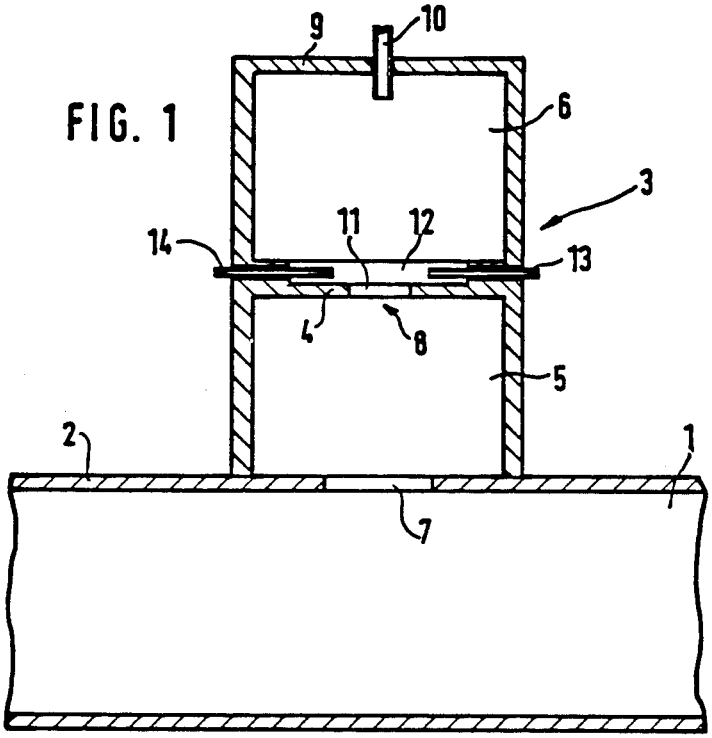
FIG. 1 is a cross sectional view of an embodiment of an arrangement according to the invention.
Figure 2:
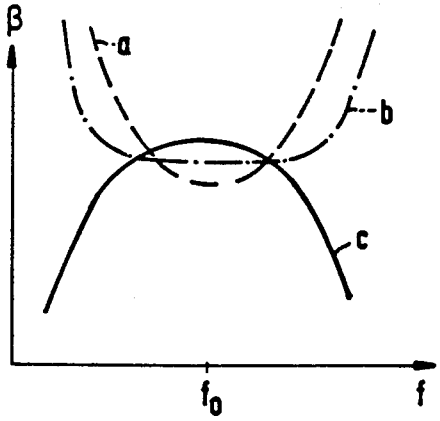
FIG. 2 is a diagram showing time delay curves used to explain the invention.
Figure 3:
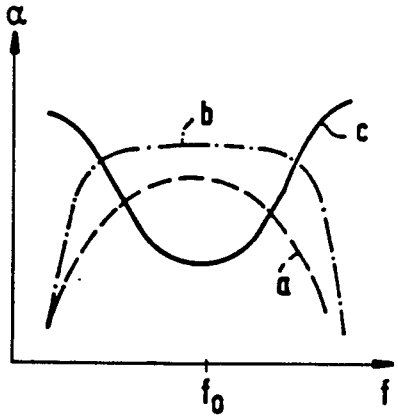
FIG. 3 is a diagram showing attenuation curves for a filter with and without an equalizer.

FIG. 1 represents a partial longitudinal cross section of a rectangular waveguide 1 which is connected to a not-shown filter and a two-circuit cavity resonator 3 coupled to one side 2 of waveguide 1. This two-circuit cavity resonator 3 has the task of influencing the time delay and amplitude of the field traversing waveguide 1. From the time delay characteristics $\beta$, shown in FIG. 2, and attenuation characteristics $\alpha$, shown in FIG. 3, the curves $\alpha$ which are flat within only a very narrow frequency band are the characteristics of a filter without an equalizer. These characteristics (curves a) are to be modified by the equalizer so as to present the most frequency-independent characteristics possible over a wide frequency band (cf. curves b).

This object is achieved with an equalizer whose time delay curve (curve c in FIG. 2) and attenuation curve (curve c in FIG. 3) present a variation in frequency which is opposite to the curves a of a filter without an equalizer. Such equalizer characteristics result when the waveguides of the equalizer are critically coupled with respect to time delay.

In the present embodiment, the equalizer has two round waveguide sections 5 and 6 that are about $n\cdot(\lambda_{gc}/2)$ in length, waveguide section 5 and 6 being arranged one behind the other in the axial direction and being separated from each other by a partition 4, where $\lambda_{gc}$ is the wavelength in the round waveguide sections and $n=1, 2, 3 \ldots$.

The first of the two round waveguides, 5, is coupled to a waveguide 1 via a coupling aperture 7 provided in waveguide wall 2. Coupling aperture 7 is located at a point in waveguide 1 where two mutually perpendicular components of the magnetic field (Hx, Hy) are equal, so that a circularly polarized field couples into first round waveguide section 5. Both round waveguide sections 5 and 6 are coupled with each other via a second coupling aperture 8 provided in partition 4. Both coupling apertures 7 and 8 may, for instance, be of rectangular, circular or cross-slotted shape, but, as already mentioned, they must be dimensioned so that the entire cavity resonator 3 is critically coupled with respect to time delay characteristics.

Coupling aperture 7 in wall 2 of waveguide 1 is larger than coupling aperture 8 in partition 4 because the coupling coefficient between waveguide 1 and first round waveguide section 5 must be larger than the coupling coefficient between the first and second round waveguide sections 5 and 6, respectively. The coupling coefficient of larger coupling aperture 7 is, for example, in the range of 0.2 to 0.3 and the coupling coefficient of the smaller coupling aperture 8 is, for example, in the range of 0.014 to 0.025.

The coupling coefficient is a value which is proportional to the square root of the power coupled from one waveguide section to the other.

The precondition for there being no break in the attenuation curve or time delay curve of cavity resonator 3 in the vicinity of resonance frequency fo is that the quality factors of the two resonator circuits be about equal. But, the resonator circuit formed by first round waveguide section 5 has a smaller quality factor than the resonator circuit formed by second round waveguide section 6. This is due to the fact that the first resonator circuit has larger apertures in the partitions that define it (namely, large coupling aperture 7 and small coupling aperture 8) than the second resonator circuit whose partition is pierced only by small coupling aperture 8. The quality factor of the second resonator circuit is tuned to the quality factor of the first resonator circuit by a tuning screw 10 which is inserted into shorting wall 9 of the second round waveguide section 6. Screw 10 is made of a power-absorbing material, such as epoxide filled with magnetic powder. Power-absorbing screw 10 influences only the attenuation characteristic $\alpha$ and, thus, the quality factor (Q=approx. $1/\alpha$) of the second resonator circuit. Screw 10 does not influence the time delay characteristics $\beta$ of the second resonator circuit, nor does it modify its resonance frequency.

Along with attenuation tuning, the present equalizer also provides for time delay tuning, the latter being designed so that it will not affect attenuation. Time delay attenuation is effected as follows:

Coupling aperture 8 in partition 4 between the two round waveguide sections 5 and 6 presents a stepped cross section presenting areas 11 and 12. In this connection, it is advisable to have the area of aperture 8 with the smaller cross section adjacent the resonator circuit that has the smaller quality factor of the two mutually coupled resonator circuits, so as not to reduce this quality factor further by widening of the coupling aperture. To this effect, the area 11 of coupling aperture 8 with the smaller cross section in the present embodiment opens into round waveguide section 5 which has the smaller quality factor. In area 12 which has larger diameter than area 11 and is adjacent round waveguide section 6, at least two screws 13, 14 are symmetrically arranged with respect to the longitudinal axis of cavity resonator 3 and protrude through partition 4 perpendicularly to such longitudinal axis. The penetration depth of these screws 13, 15 into area 12 determines the equalizer's time delay characteristics. The further the screws 13, 14 are screwed into area 12 the wider will be the time delay curve in the vicinity of resonance frequency fo (cf. curve c in FIG. 2).

In the case of an equalizer for a bandpass filter of 55 MHz bandwidth, for instance, the coupling coefficient for coupling aperture 8 is about 0.014 when it has a small diameter of 4.8 mm and a large diameter of 12 mm and the coupling coefficient of coupling aperture 7 is about 0.2 when it has a cross section of 8 mm. For a bandpass filter of 110 MHz bandwidth, for example, the coupling coefficient for coupling aperture 8 is about 0.025 for a small diameter of 5.8 mm and a large diameter of 12 mm, and the coupling coefficient for coupling aperture 7 is about 0.3 for a cross section of 8.5 mm.

The foregoing figures for the dimensions of the coupling apertures are frequency-dependent and are valid only for a certain value of the ratio $\alpha_r/\lambda_{gr}$ and $d/\lambda_{gc}$, respectively.

$\alpha_r \triangleq$ width of rectangular waveguide filter
$\lambda_{gr} \triangleq$ wavelength in rectangular waveguide filter
$d \triangleq$ diameter inside round waveguide sections
$\lambda_{gc} \triangleq$ wavelength in round waveguide sections)

$$\lambda_{gr} = \frac{\lambda_o}{\sqrt{1-\left(\frac{\lambda_o}{2\alpha_r}\right)^2}}, \quad \lambda_{gc} = \frac{\lambda_o}{\sqrt{1-\left(\frac{\lambda_o}{1{,}7\,d}\right)^2}}$$

In one embodiment of the invention:
$\alpha_r = 19.05$ mm
$d = 20$ mm
$f_o = 14$ GHz $\lambda_o = 21.4$ mm The present disclosure relates to the subject matter disclosed in German Ser. No. P 35 36 001.1 of Oct. 9th, 1985, the entire specification of which is incorporated herein by reference.

It will be understood that the above description of the present invention is susceptible to various modifications, changes and adaptations, and the same are intended to be comprehended within the meaning and range of equivalents of the appended claims.

What is claimed is:

1. An arrangement for the equalization of attenuation and time delay in a microwave filter utilizing waveguide technology, the filter having time delay characteristics which vary as a function of frequency, comprising an equalizer composed of a multi-circuit cavity resonator coupled via a first coupling aperture to a waveguide which is connected to the filter, the multi-circuit cavity resonator having a longitudinal axis and including at least two individual waveguide sections coupled to each other via a second coupling aperture, the coupling apertures being dimensioned so that the individual waveguide sections and the waveguide are critically coupled with respect to time delay characteristics so that the time delay characteristics of the filter become substantially frequency-independent over a wide band of frequencies, the improvement wherein:

said multi-circuit cavity resonator includes power-absorbing tuning means for tuning all of said waveguide sections to substantially the same quality factor;

said second coupling aperture coupling said waveguide sections with each other presents a stepped cross section defining a first area and a second area having a larger cross section than said first area; and said multi-circuit cavity resonator includes at least two screws arranged symmetrically with respect to said longitudinal axis of said multi-circuit cavity and protruding laterally into said second coupling aperture in said second area of larger cross section, said screws influencing the time delay of said equalizer arrangement as a function of their depth of penetration into said second area.

2. Arrangement as in claim 1, wherein the waveguide section farthest removed from said waveguide connected to the filter has an end comprising a shorting wall and said tuning means comprises a tuning screw made of an epoxide filled with magnetic powder and protruding through said shorting wall into said farthest removed waveguide section.

3. Arrangement as in claim 1, wherein said multi-circuit cavity resonator comprises a two-circuit cavity resonator having first and second individual waveguide sections;

said first coupling aperture is between said waveguide connected to the filter and said first waveguide section and is dimensioned to have a coupling coefficient in a range between 0.2 and 0.3; and said second coupling aperture is between said first waveguide section and said second waveguide section and is dimensioned to have a coupling coefficient in a range between 0.014 and 0.025.

4. Arrangement as in claim 1, wherein said first area of said second coupling aperture with the smaller cross section is adjacent that waveguide section of said two waveguide sections that has the smaller quality factor.

5. An equalizer for use with a hollow waveguide which is connected to a microwave filter, the hollow waveguide having a wall with a coupling aperture, comprising:

a first waveguide section having a first cavity therein, the first waveguide section being mounted on the hollow waveguide with the first cavity communicating with the interior of the hollow waveguide through the coupling aperture, the first waveguide section additionally having a first end which is spaced apart from the wall of the waveguide and which has a further coupling aperture, the further coupling aperture having a stepped cross section which defines a first area and a second area having a larger cross section than the first area;

a second waveguide section having a second cavity therein, the second waveguide section being mounted on the first waveguide section so that the second cavity communicates with the first cavity through the further coupling aperture, the second waveguide section additionally having a second end which is spaced apart from the first end;

power-absorbing tuning means, extending into the second cavity, for tuning both waveguide sections to substantially the same quality factor;

at least one adjustment element; and means for movably mounting the at least one adjustment element so that at least a portion thereof extends into the second area of the further coupling aperture.

6. The equalizer of claim 5, wherein the power-absorbing tuning means comprises a tuning screw which extends through the second end.

7. The equalizer of claim 6, wherein the tuning screw comprises magnetic powder and a binder.

8. The equalizer of claim 5, wherein the at least one adjustment element comprises a plurality of symmetrically disposed elongated elements.

9. The equalizer of claim 8, wherein the elongated elements are screws.

10. The equalizer of claim 5, wherein the coupling aperture in the wall of the waveguide has a coupling coefficient ranging from about 0.2 to about 0.3, and wherein the further coupling aperture has a coupling coefficient ranging from about 0.014 to about 0.025.

11. The equalizer of claim 5, wherein the first area of the further coupling aperture is directed toward the first cavity and the second area of the further coupling aperture is directed toward the second cavity.

12. The equalizer of claim 5, wherein the first and second waveguide sections are cylinders having substantially the same diameter.

13. The equalizer of claim 5, wherein the first and second waveguide sections are disposed along a common axis which runs through the coupling aperture and the further coupling aperture, and wherein the at least one adjustment element comprises screws having axes that are perpendicular to the common axis of the first and second waveguide sections.

* * * * *